US005353875A

United States Patent [19]

Schultz et al.

[11] Patent Number: 5,353,875

[45] Date of Patent: Oct. 11, 1994

[54] METHODS OF PERFORATING AND TESTING WELLS USING COILED TUBING

[75] Inventors: Roger L. Schultz, Richardson, Tex.; Gary O. Harkins, Wassenaar, Netherlands

[73] Assignee: Halliburton Company, Houston, Tex.

[21] Appl. No.: 148,294

[22] Filed: Nov. 8, 1993

Related U.S. Application Data

[62] Division of Ser. No. 938,066, Aug. 31, 1992, Pat. No. 5,287,741.

[51] Int. Cl.[5] ..... E21B 43/116

[52] U.S. Cl. ..... 166/297; 175/4.52

[58] Field of Search ..... 166/297, 385; 175/4.52

[56] References Cited

U.S. PATENT DOCUMENTS

| | | | |
|---|---|---|---|
| Re. 32,755 | 9/1988 | Vann | 166/250 |
| 2,261,292 | 11/1941 | Salnikov | 166/298 |
| 2,548,616 | 4/1951 | Priestman et al. | 255/4 |
| 2,567,009 | 9/1951 | Calhoun et al. | 166/1 |
| 2,600,607 | 6/1952 | Bannister | 254/135 |
| 3,055,424 | 9/1962 | Allen | 166/21 |
| 3,104,703 | 9/1963 | Rike et al. | 166/21 |
| 3,116,781 | 1/1964 | Rugeley et al. | 153/54 |
| 3,116,793 | 1/1964 | McStravick | 166/21 |
| 3,182,877 | 5/1965 | Slator et al. | 226/172 |
| 3,258,110 | 6/1966 | Pilcher | 198/162 |
| 3,285,485 | 11/1966 | Slator | 226/172 |
| 3,313,346 | 4/1967 | Cross | 166/0.5 |
| 3,330,531 | 7/1967 | Slator et al. | 253/1 |
| 3,346,045 | 10/1967 | Knapp et al. | 166/0.5 |
| 3,363,880 | 1/1968 | Blagg | 254/135 |
| 3,373,816 | 3/1968 | Cochran | 166/46 |
| 3,373,818 | 3/1968 | Rike et al. | 166/77 |
| 3,379,393 | 4/1968 | Pilcher | 242/158.4 |
| 3,401,749 | 9/1968 | Daniel | 166/46 |
| 3,525,401 | 8/1970 | Hanson et al. | 166/315 |
| 3,559,905 | 2/1971 | Palynchuk | 242/54 |
| 3,606,927 | 9/1971 | True et al. | 166/315 |
| 3,658,270 | 4/1972 | Slator et al. | 242/54 |
| 3,667,554 | 6/1972 | Smitherman | 175/57 |
| 3,675,718 | 7/1972 | Kanady | 166/297 |
| 3,675,719 | 7/1972 | Slator et al. | 166/297 |
| 3,690,136 | 9/1972 | Slator et al. | 72/160 |
| 3,690,381 | 9/1972 | Slator et al. | 166/315 |
| 3,706,344 | 12/1972 | Vann | 166/297 |
| 3,717,095 | 2/1973 | Vann | 102/21.6 |
| 3,722,589 | 3/1973 | Smith et al. | 166/250 |
| 3,722,594 | 3/1973 | Smith et al. | 166/305 R |

(List continued on next page.)

FOREIGN PATENT DOCUMENTS 2648863 6/1989 France .

OTHER PUBLICATIONS

SPE 17581 entitled "Coiled Tubing in Horizontal Wells" by R. E. Cooper, PT. Dowell Schlumberger Indonesia, Nov., 1988.

(List continued on next page.)

*Primary Examiner*—William P. Neuder

*Attorney, Agent, or Firm*—Tracy W. Druce; Lucian Wayne Beavers

[57] ABSTRACT

Methods of draw-down and build-up testing on existing production wells are disclosed. The testing may be accomplished without removing the production tubing string from the well. The production of the well is shut down and then a coiled tubing test string is run down into the production tubing string. The coiled tubing test string includes a coiled tubing string, a tester valve carried by the coiled tubing string, and a test packer carried by the coiled tubing string. The test packer is set within one of the casing bore and the production tubing bore above perforations which communicate the casing bore with a subsurface formation. Draw-down and build-up testing of the subsurface formation can then be accomplished by opening and closing the tester valve to selectively flow well fluid up through the coiled tubing string or shut in the coiled tubing string. After the draw-down/build-up testing is completed, the coiled tubing test string is removed from the well and production of the well is resumed up through the production tubing bore of the production tubing string. Optionally, the coiled tubing test string may carry a perforating gun to perforate a new zone of the well which may then be tested.

6 Claims, 4 Drawing Sheets

U.S. PATENT DOCUMENTS

| | | | |
|---|---|---|---|
| 3,765,489 | 10/1973 | Maly | 166/310 |
| 3,791,447 | 2/1974 | Smith et al. | 166/311 |
| 3,807,502 | 4/1974 | Heilhecker et al. | 166/315 |
| 3,835,929 | 9/1974 | Suman, Jr. | 166/315 |
| 3,841,407 | 10/1974 | Bozeman | 166/315 |
| 3,866,679 | 2/1975 | Laky | 166/77 |
| 3,912,014 | 10/1975 | Wetzel | 166/315 |
| 4,064,355 | 12/1977 | Neroni et al. | 174/47 |
| 4,091,867 | 5/1978 | Shannon, Jr. et al. | 166/77 |
| 4,336,415 | 6/1982 | Walling | 174/47 |
| 4,345,784 | 8/1982 | Walling | 285/39 |
| 4,374,530 | 2/1983 | Walling | 138/110 |
| 4,509,604 | 4/1985 | Upchurch | 175/4.52 |
| 4,515,220 | 5/1985 | Sizer et al. | 166/384 |
| 4,553,590 | 11/1985 | Phillips | 166/53 |
| 4,570,705 | 2/1986 | Walling | 166/77 |
| 4,585,061 | 4/1986 | Lyons, Jr. et al. | 166/77 |
| 4,612,984 | 9/1986 | Crawford | 166/77 |
| 4,621,403 | 11/1986 | Babb et al. | 29/433 |
| 4,640,353 | 2/1987 | Schuh | 166/248 |
| 4,655,291 | 4/1987 | Cox | 166/385 |
| 4,673,035 | 6/1987 | Gipson | 166/77 |
| 4,682,657 | 7/1987 | Crawford | 166/385 |
| 4,694,901 | 9/1987 | Skinner | 166/77 |
| 4,715,443 | 12/1987 | Gidley | 166/250 |
| 4,743,175 | 5/1988 | Gilmore | 417/361 |
| 4,793,417 | 12/1988 | Rumbaugh | 166/312 |
| 4,817,718 | 4/1989 | Nelson et al. | 166/297 |
| 4,830,120 | 5/1989 | Stout | 175/4.51 |
| 4,844,166 | 7/1989 | Going, III et al. | 166/379 |
| 4,860,831 | 8/1989 | Caillier | 166/384 |
| 4,862,958 | 9/1989 | Pringle | 166/72 |
| 4,865,131 | 9/1989 | Moore et al. | 166/384 |
| 4,866,607 | 9/1989 | Anderson et al. | 364/422 |
| 4,877,089 | 10/1989 | Burns | 166/377 |
| 4,899,823 | 2/1990 | Cobb et al. | 166/351 |
| 4,919,204 | 4/1990 | Baker et al. | 166/223 |
| 4,923,005 | 5/1990 | Laky et al. | 166/55 |
| 4,936,387 | 6/1990 | Rubbo | 166/387 |
| 4,938,060 | 7/1990 | Sizer et al. | 73/151 |
| 4,940,095 | 7/1990 | Newman | 166/378 |
| 4,941,349 | 7/1990 | Walkow et al. | 73/151 |
| 4,949,793 | 8/1990 | Rubbo et al. | 166/382 |
| 4,962,815 | 10/1990 | Schultz et al. | 166/387 |
| 4,971,153 | 11/1990 | Rowe et al. | 166/385 X |
| 4,979,567 | 12/1990 | Rubbo | 166/297 |
| 4,986,360 | 1/1991 | Laky et al. | 166/351 |
| 4,986,362 | 1/1991 | Pleasants | 166/382 |
| 5,002,130 | 3/1991 | Laky | 166/351 |
| 5,025,861 | 6/1991 | Huber et al. | 166/297 |
| 5,027,903 | 7/1991 | Gipson | 166/382 |
| 5,029,642 | 7/1991 | Crawford | 166/72 |
| 5,036,917 | 8/1991 | Jennings, Jr. et al. | 166/297 X |
| 5,044,437 | 9/1991 | Wittrisch | 166/385 X |
| 5,058,674 | 10/1991 | Schultz et al. | 166/264 |
| 5,070,941 | 12/1991 | Kilgore | 166/98 |
| 5,088,559 | 2/1992 | Taliaferro | 166/373 |
| 5,090,481 | 2/1992 | Pleasants et al. | 166/373 |
| 5,095,979 | 3/1992 | Perricone | 166/138 |
| 5,138,876 | 8/1992 | Moore et al. | 166/250 |
| 5,165,274 | 11/1992 | Thiercelin | 73/151 |
| 5,165,276 | 11/1992 | Thiercelin | 73/155 |

OTHER PUBLICATIONS

"Proposal to Develop and Evaluate Slim Hole and Coiled Tubing Technology" prepared by Maurer Engineering Inc., of Houston, Tex., dated Sep., 1991—Not Admitted To Be Prior Art.

METHODS OF PERFORATING AND TESTING WELLS USING COILED TUBING

This is a divisional of copending application Ser. No. 07/938,066 filed on Aug. 31, 1992 now U.S. Pat. No. 5,287,741.

BACKGROUND OF THE INVENTION

1. Field of the Invention

The present invention is directed to methods of perforating and/or testing an existing production well.

2. Description of the Prior Art

It is often desirable to perform flow tests to evaluate the performance of a well. A flow test can be performed at various stages in the development and life of a well. For instance, a flow test may be performed while the well is being drilled, before casing is set. A flow test may also be performed on a new or exploratory well in which casing has been set, but completion operations have not been undertaken. Finally, it is sometimes desirable to test a well which has been completed and placed on production for some time. In this last instance, tests on wells which contain production tubing are usually less comprehensive or are much more expensive than tests conducted on wells prior to the installation of production tubing. This is because conventional flow testing equipment cannot be run through the production tubing, and thus either modified tests must be utilized or the production tubing must be removed from the well so conventional testing equipment can be placed in the well.

Conventional testing equipment typically utilizes drill stem test tools which are conveyed on drill pipe, threaded tubing, electric line, or slick line.

The present invention provides methods for easily and economically conducting comprehensive draw-down and build-up testing on existing production wells without the need for removing the production tubing string from the well. Methods are also provided for perforating a new zone of an existing production well.

SUMMARY OF THE INVENTION

A method of testing of production well is provided. The production well includes a casing set in a borehole which intersects a subsurface formation. The casing has a casing bore having perforations communicating the casing bore with a first zone of the subsurface formation. A production tubing string is received within the casing and has a production tubing bore. A production packer seals between the casing bore and the production tubing string above the perforations of the casing. After the well has been on production for some time, and it is desired to perform flow tests to evaluate the performance of the well, this can be accomplished as follows.

First, the production of well fluids up through the production tubing bore is shut down.

Then while leaving the production tubing string in place in the well, a coiled tubing test string is run downward into the production tubing string. The coiled tubing test string includes a coiled tubing string, a tester valve carried by the coiled tubing string, and a test packer carried by the coiled tubing string. The coiled tubing test string may also include other tools such as safety valves, circulating valves, samplers, and electronic gauges and recorders.

The test packer is then set within either the casing bore or the production tubing bore above the perforations of the casing.

Then the tester valve is opened and closed to perform draw-down and build-up tests, respectively, on the subsurface formation by either selectively flowing well fluids from the subsurface formation up through the coiled tubing string or selectively shutting in the coiled tubing string.

After the draw-down/build-up testing is completed, the coiled tubing test string is removed from the production tubing. Then, production of the well is resumed by producing well fluids through the perforations and up through the production tubing bore.

The coiled tubing test string may also include a perforating gun which can be used to perforate a new zone of the subsurface formation. The new zone can be isolated prior to perforating, and then draw-down and build-up tests may be conducted on the new zone.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 1A shows the upper portion of the well and FIG. 1B shows the lower portion of the well.

DETAILED DESCRIPTION OF THE PREFERRED EMBODIMENT

Figure 1A:
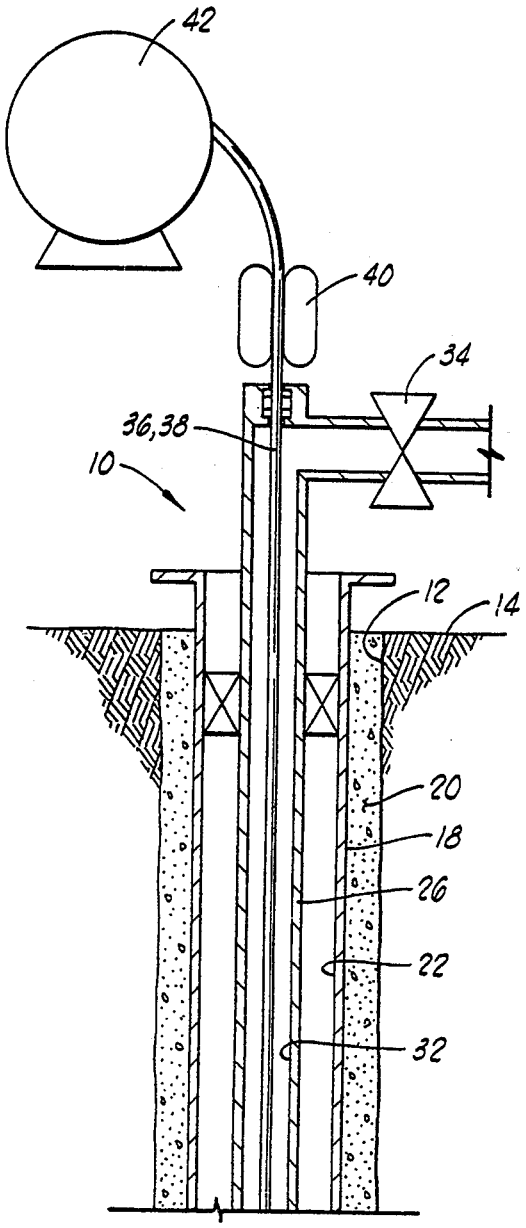
FIGS. 1A–1B comprise an elevation sectioned schematic view of a production well having a coiled tubing test string in place therein for conducting draw-down and build-up testing on the production well.

Referring now to the drawings, and particularly to FIG. 1A, a well is shown and generally designated by the numeral 10. The well 10 is formed by drilling a borehole 12 down through the earth's surface 14 to intersect a subsurface formation 16.

The well 10 includes a casing 18 set within the borehole 12 and cemented in place therein by cement 20. The casing 18 has a casing bore 22. Casing 18 has a plurality of perforations such as 24 extending there-through and communicating the casing bore 22 with the subsurface formation 16.

A production tubing string 26 is concentrically received within the casing 22. A production packer 28 seals between the casing bore 22 and the production tubing string 26 near a lower end 30 of production tubing string 26. The production packer 28 is located above the perforations 24 so that when the well 10 is in production, formation fluid from the subsurface formation 16 flows inward through the perforations 24, then in through the open bottom end 30 of production tubing string 28 and up through a production tubing bore 32. The upper end of the well 10 includes a conventional well head schematically illustrated at 34 for controlling flow of fluids through the production tubing 26.

When it is desired to evaluate the performance of the well 10 by conducting flow tests thereon in accordance with the methods of the present invention, the production of well fluids up through the production tubing bore 32 is shut down by closing appropriate valves on the wellhead 34.

Then, while leaving the production tubing string 26 in place within the well 10, a coiled tubing test string generally designated by the numeral 36 is run downward into the production tubing string 26.

The coiled tubing test string includes a coiled tubing string 38 which is continuously inserted down into the production tubing string 26 with a coiled tubing injector apparatus 40. The coiled tubing is previously stored on a large reel 42 before being unreeled and inserted into the well 10.

Figure 1B:
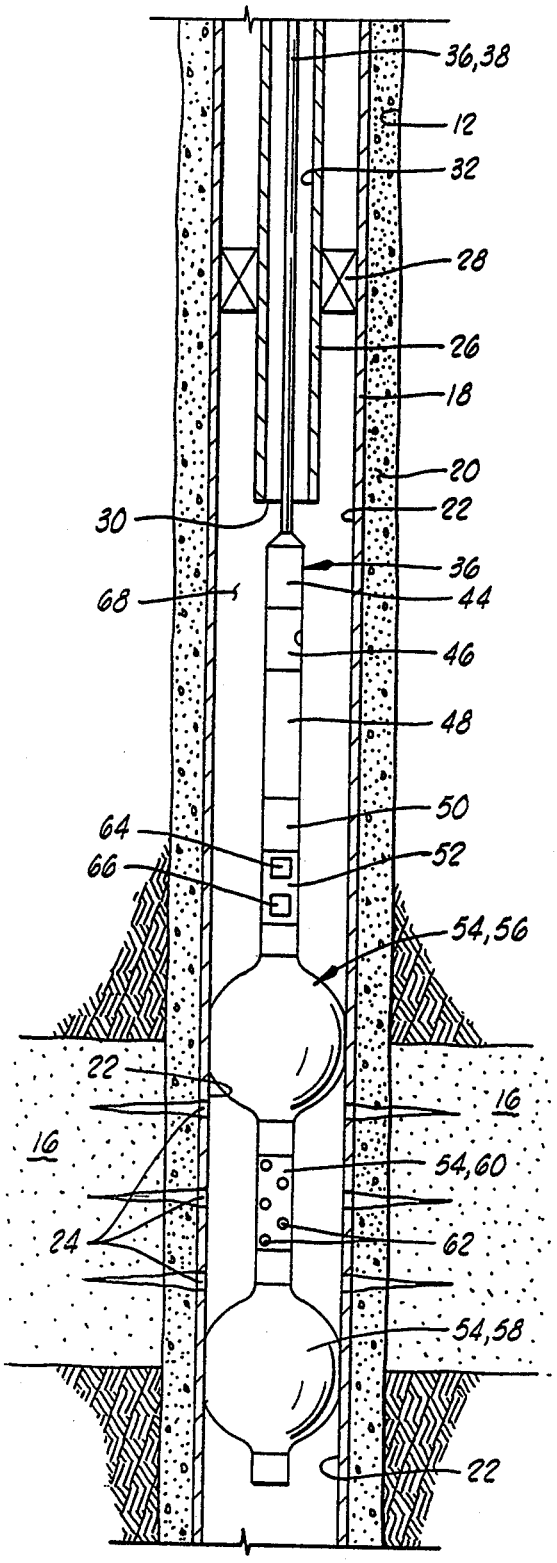

The coiled tubing test string 36 includes a plurality of tools carried by the coiled tubing string 38 on its lower end. Those tools as schematically illustrated in FIG. 1B include a reverse circulating valve 46, a tester valve 48, a sampler 50, a gauge carrier 52, and a straddle packer generally designated by the numeral 54. The straddle packer 54 includes upper and lower inflatable packer elements 56 and 58, respectively, and includes a screen 60 having a plurality of flow ports 62 therein which communicate the interior of the coiled tubing test string 38 with the interior of casing 18 between the upper and lower packer elements 56 and 58.

The coiled tubing test string 36 may also carry a number of joints of conventional threaded pipe, schematically indicated at 44, above circulating valve 46. The threaded pipe will better withstand the higher hydrostatic pressures in the deeper portions of well 10.

The coiled tubing test string 36 with the various tools just described attached thereto is run down through the production tubing bore 32 with the upper and lower packer elements 56 and 58 in an uninflated position.

Due to the lower collapse resistance of coiled tubing as compared to threaded joint tubing, precautions must be taken to prevent collapse of the coiled tubing when producing well fluids up through the coiled tubing. To prevent hydrostatic pressure in the well from collapsing the coiled tubing, the coiled tubing should be allowed to fill with well fluid as it is run into the well. Then prior to testing the well, the well fluid can be flushed from the coiled tubing with nitrogen gas.

When the straddle packer 54 is in the position generally shown in FIG. 1B, the upper and lower packer elements 56 and 58 are inflated to seal against the casing bore 22 above and below the perforations 24, respectively. Formation fluid from the subsurface formation 16 may then communicate through the perforations 24 and through the flow ports 62 with the interior of the coiled tubing test string 38.

Then, the tester valve 48 can be opened to selectively flow the well fluid from the subsurface formation 16 up through the coiled tubing string 38. The tester valve 48 can be closed to shut in the subsurface formation 16. This can be repeated to perform multiple draw-down and build-up tests.

Throughout this repeated draw-down and build-up testing, various parameters of the well such as the pressure of the fluids produced from the well may be measured by various instrumentation carried by gauge carrier 52. For example, the gauge carrier 52 may include a pressure sensor 64 for measuring pressure, and a recorder 66 for recording those pressure measurements for later analysis.

Also, at a desired time during the draw-down and build-up testing, one or more samples of well fluid may be trapped in sampler 50, and the sampler 50 with its trapped sample will subsequently be retrieved from the well 10 when the coiled tubing test string 36 is retrieved from the well 10.

After the draw-down and build-up testing is completed, it may be desired to eliminate all well fluids from the coiled tubing string 38, and this can be done by opening the reverse circulating valve 46 and then pumping a flushing fluid downward through the coiled tubing string 38 and pushing well fluid therefrom back into an annulus 68 between the coiled tubing test string 36 and the casing bore 22.

After the draw-down and build-up testing operations are completed, the coiled tubing test string 36 may be retrieved from the production tubing 26, and then production of the well 10 may be resumed by opening the appropriate valves on wellhead 34 and again permitting well fluids to flow through the perforations 24 and up through the production tubing bore 32 to the surface.

Thus, a method is provided for economically and easily conducting comprehensive draw-down and build-up testing on a production well without removing the production tubing string 26 from the well.

Various forms of each of the tools carried by the coiled tubing string 38 may be utilized. The following are some examples of presently preferred tools.

The straddle packer 54 may be constructed in accordance with the teachings of U.S. Pat. No. 4,962,815 to Schultz et al., and assigned to the assignee of the present invention, the details of which are incorporated herein by reference. The straddle packer of U.S. Pat. No. 4,962,815 is set by inflation fluid pumped down through the coiled tubing string. The straddle packer of U.S. Pat. No. 4,962,815 is disclosed for use in well treating operations where fluid is pumped down through the coiled tubing string. It may, however, be utilized for draw-down and build-up testing when assembled in combination with the other tools such as tester valve 48 disclosed herein. Longitudinal reciprocation of the upper end of the tool by picking up and setting down weight with the coiled tubing string allows the inflatable straddle packer 54 to move between an endlessly repeating sequence of an inflating position, a treating or in this instance production testing position, an equalizing position wherein fluid pressure above and below the packer elements is equalized, and a ready position wherein the tool is ready to return to the original inflating position. When the tool is returned to the original inflating position, the upper and lower packer elements 56 and 58 may be deflated to allow the straddle packer to be removed from the well.

The gauge carrier 52 and pressure sensor 64 and recording apparatus 66 may for example be an instream gauge carrier and electronic memory gauge available from Halliburton Services, such as shown in U.S. Pat. No. 4,866,607 to Anderson et al.

The sampler apparatus 50 may for example be constructed in accordance with U.S. Pat. No. 5,058,674 to Schultz et al.

The tester valve 48 preferably is constructed to open and close by picking up and setting down weight with the coiled tubing string 38. Alternatively, the tester valve 48 may be controlled by an electric wireline.

The tester valve 48 may for example be a Hydrospring® tester available from Halliburton Services of Duncan, Okla.

The circulating valve 46 may for example be a Hydraulic Circulating Valve available from Halliburton Services of Duncan, Okla.

Other forms of the various tools described above may be utilized. Also, other means of operating the various tools can be utilized.

Figure 2:
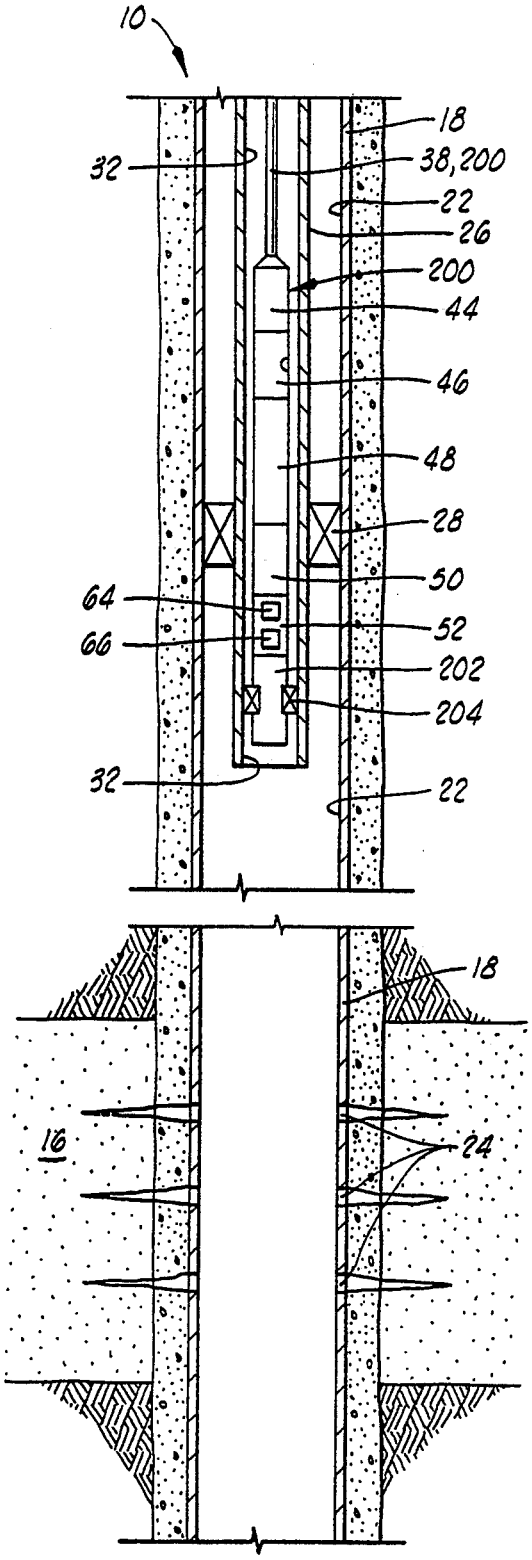
FIG. 2 is a view similar to FIG. 1B showing an alternative form of the coiled tubing test string for carrying out the methods of the present invention. The upper portions of the well of FIG. 2 are identical to that shown in FIG. 1A.

The Embodiment of FIG. 2

In FIG. 2, a modified coiled tubing test string is generally designated by the numeral 200. Most of its components are identical to the coiled tubing test string 38 and such identical components are indicated by the identical identifying numerals utilized with regard to FIGS. 1A–1B.

In the coiled tubing test string 200, the straddle packer 54 has been eliminated and has been replaced by a test packer 202 having an annular sealing element 204 which is sealingly received within the production tubing bore 32. The annular sealing element 204 of test packer 202 may either be an inflatable sealing element 204 or a compression set sealing element 204.

For example, the test packer 202 may be a Champ® packer or RTTS packer available from Halliburton Services of Duncan, Okla.

With the arrangement of FIG. 2, the test packer 202 is set within the production tubing bore 32, instead of the casing bore 22, but it still is set above the perforations 24 of casing 18 and will control the flow of well fluid from the formation 16 up through the coiled tubing string 38. For all of the various forms of test packers disclosed with the several embodiments described herein, the test packer is set within one of the casing bore 22 and the production tubing bore 32.

Figure 3:
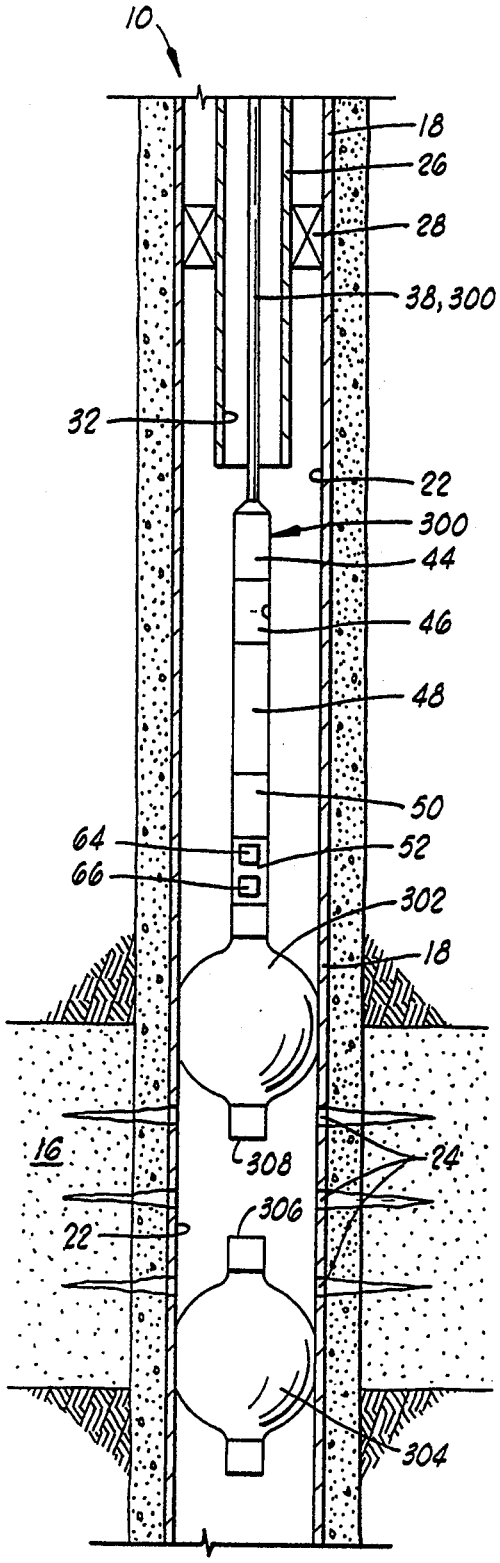
FIG. 3 is another view similar to FIG. 1B showing another alternative arrangement for a coiled tubing test string suitable for carrying out the methods of the present invention. Again, the upper portions of the well of FIG. 3 are identical to that shown in FIG. 1A.

The Embodiment Of FIG. 3

In FIG. 3, another alternative version of the coiled tubing test string is shown and generally designated by the numeral 300. Again, the difference as compared to the coiled tubing test string 36 of FIGS. 1A–1B lies in the type of test packer utilized. In this instance, the straddle packer 54 has been replaced with an inflatable test packer 302, and an inflatable bridge plug 304.

When the coiled tubing test string 300 is initially run into place within the well 10, the test packer 302 and bridge plug 304 are both in an uninflated position, and an upper end 306 of bridge plug 304 is connected to a lower end 308 of test packer 302.

The coiled tubing test string 300 is lowered into the well 10 until the bridge plug 304 is at a depth below the perforations 24. Then the bridge plug 304 is inflated as shown in FIG. 3 to block the casing bore 22 below the perforations 24. Then the upper end 306 of bridge plug 304 is released from the lower end 308 of test packer 302, and the coiled tubing test string 300 is raised until the test packer 302 is located above the perforations 24. Then the test packer 302 is inflated to seal against the casing bore 22 above the perforations 24 as illustrated in FIG. 3. Then flow of formation fluid from the subsurface formation 16 passes through the perforations 24 and up through the open lower end 308 of test packer 302 and flows up through the coiled tubing string 38 under the control of tester valve 48.

After the testing is completed, the test packer 302 is deflated, and then the coiled tubing test string 300 is lowered to again engage the lower end 308 of test packer 302 with the upper end 306 of bridge plug 304. The bridge plug 304 is then deflated, and the entire coiled tubing test string 300 is retrieved from the well. Alternatively, if desired, the bridge plug 304 may be left in place in the well.

Figure 4:
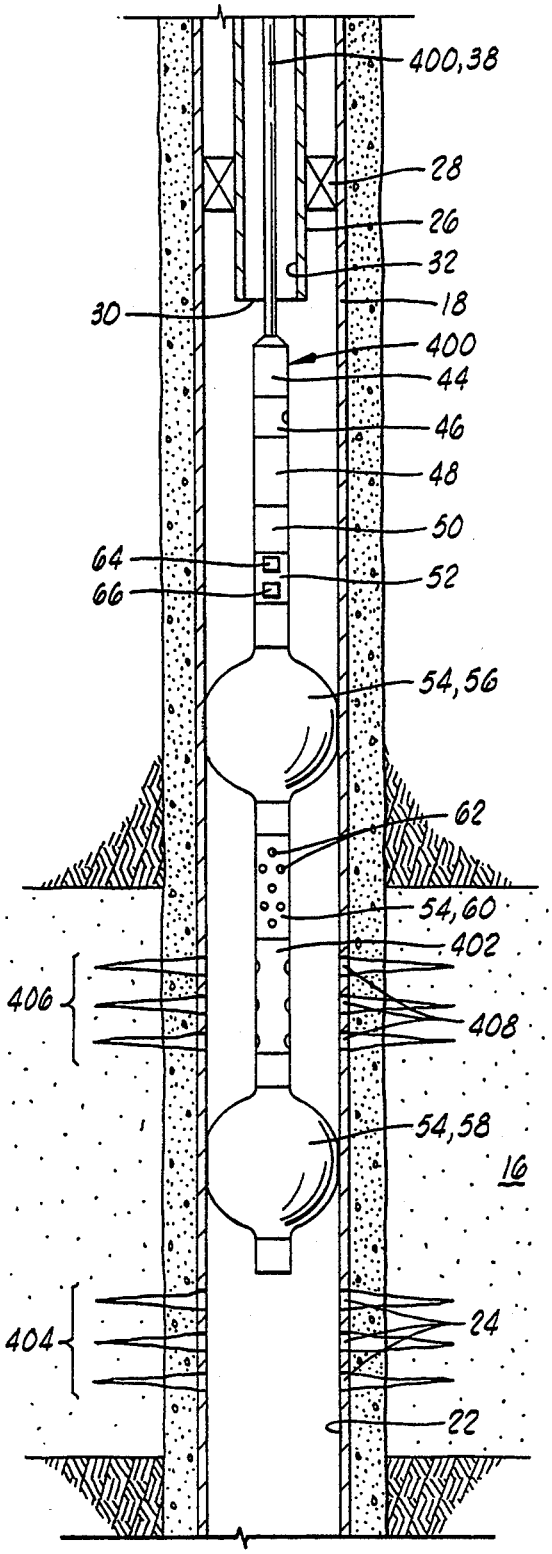
FIG. 4 is another view similar to FIG. 1B showing another alternative form of the coiled tubing test string which is similar to that of FIG. 1B with the addition of a perforating gun located between the upper and lower packer elements of the straddle packer.

The Embodiment Of FIG. 4

In FIG. 4, a modified coiled tubing string is generally designated by the numeral 400. The coiled tubing test string 400 is similar to the coiled tubing test string 36 of FIG. 1B, except that a perforating gun 402 has been added between the upper and lower packer elements 56 and 58 of the straddle packer 54.

The previously existing perforations 24 described with regard to FIG. 1B are shown in FIG. 4 and may be described as identifying a first subsurface zone 404 of the subsurface formation 16. The first subsurface zone 404 may also be referred to as a pre-existing subsurface zone 404.

FIG. 4 illustrates how the modified coiled tubing test string 400 including the perforating gun 402 may be utilized to perforate and test a new subsurface zone 406.

This is accomplished by setting the straddle packer 54 with the upper packer element 56 above the new zone 406 and with the lower packer element 58 below the new zone 406 and above the pre-existing zone 404. The straddle packer 54 is inflated and this isolates the second zone 406 from the hydrostatic pressure of the column of well fluid standing in the production tubing bore 32 and also isolates the second zone 406 from the pre-existing zone 404.

After the upper and lower packer elements 56 and 58 have been inflated to isolate the new zone 406, the perforating gun 402 is fired to form a plurality of perforations 408 through the casing 18 thus defining the new zone 406. The perforations 408 of the new subsurface zone 406 may communicate with the same geological subsurface formation 16 or with another geological formation.

Once the new zone 406 has been perforated, it may be immediately flow tested by flowing fluid therefrom through the screen 60 and up through the coiled tubing string 38 under control of the tester valve 48 as previously described.

After the testing operation is completed, the upper and lower packer elements 56 and 58 are deflated and the coiled tubing test string 400 is withdrawn from the well 10. Production can then be resumed from the well 10 from both the pre-existing zone 404 and the new zone 406.

Also, if it is desired to resume production of the well solely from the new zone 406, this can be accomplished by placing a bridge plug (not shown) similar to bridge plug 304 of FIG. 3 within the casing bore 22 between the pre-existing zone 404 and the new zone 406.

Figure 5:
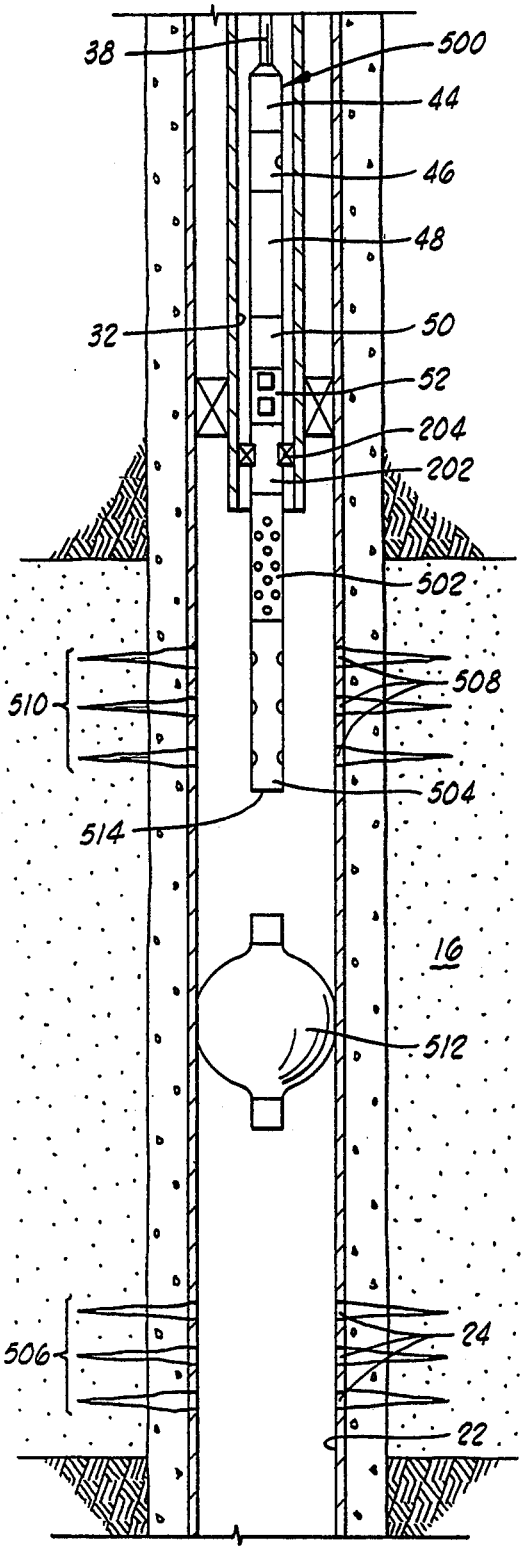
FIG. 5 shows another alternative arrangement for a coiled tubing test string similar to that of FIG. 2 and including a production screen and perforating gun with an optional bridge plug located therebelow.

The Embodiment Of FIG. 5

FIG. 5 illustrates another alternative version of the coiled tubing test string which is generally designated by the numeral 500.

The coiled tubing test string 500 is similar to the test string 200 of FIG. 2, except that a production screen or perforated sub 502 and a perforating gun 504 have been added to the coiled tubing test string 500 below the test packer 202.

Again, the previously existing perforations 24 may be described as a first or pre-existing zone 506 of the subsurface formation 16.

The perforating gun 504 is utilized to create a second set of perforations 508 defining a new zone 510 of the well.

If it is desired to isolate the new zone 510 from the pre-existing zone 506 prior to creation of the perforations 508, this can be accomplished by carrying an optional bridge plug 512 which is originally connected to the lower end 514 of perforating gun 504.

Prior to setting the packer element 204 within the production tubing bore 32, the coiled tubing test string 500 is lowered until the bridge plug 512 is at the location illustrated in FIG. 5, and then the bridge plug 512 is inflated to seal the casing bore 22 between the pre-existing zone 506 and the new zone 510.

The coiled tubing test string 500 is then raised to the location shown in FIG. 5 and the packing element 204 of test packer 202 is set within production tubing bore 32, with the perforating gun 504 being located adjacent the new zone 510 which is to be perforated.

After new zone 510 is perforated, it can be flow tested under control of tester valve 48. Then coiled tubing test string 500 is withdrawn and the well is placed back on production. Bridge plug 512 is withdrawn if it is desired to produce from both zones 506 and 510. Bridge plug 512 is left in place if it is desired to produce only new zone 510.

Figure 6:
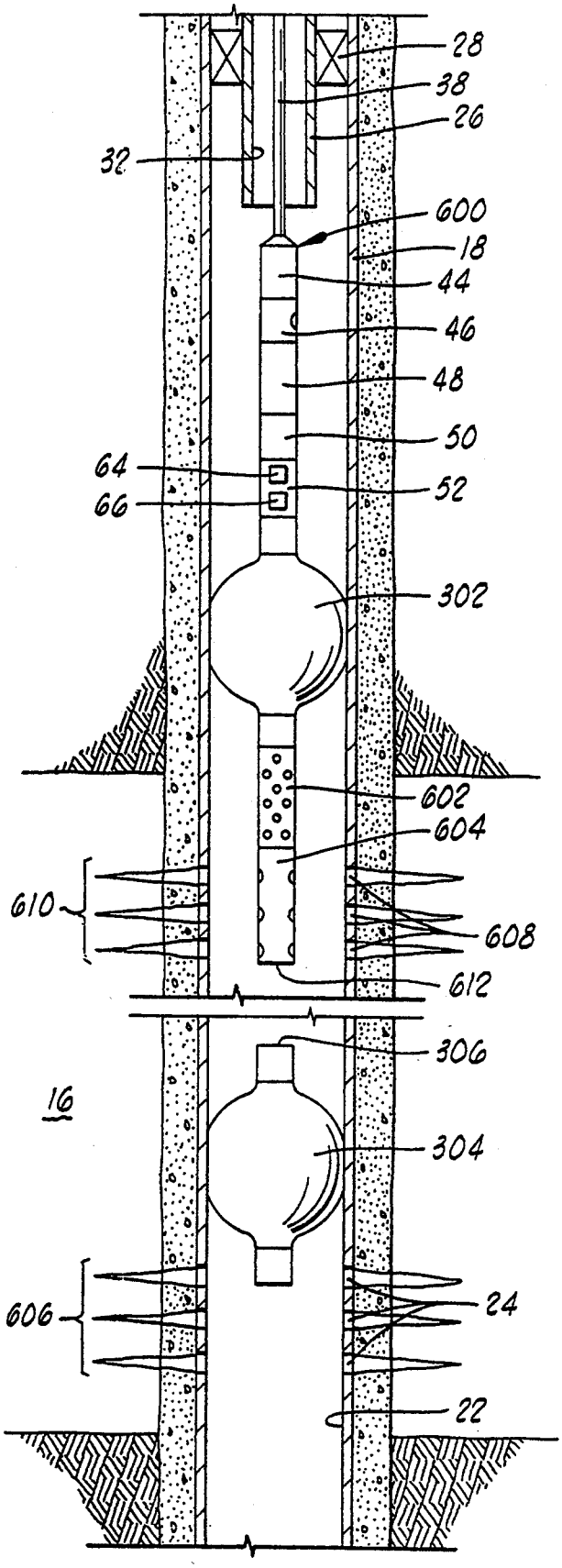
FIG. 6 shows another alternative arrangement for a coiled tubing test string which is similar to that of FIG. 6 and which has a perforating gun and a production screen added thereto below the inflatable packer.

The Embodiment of FIG. 6

FIG. 6 illustrates another alternative embodiment of the coiled tubing test string which is shown and generally designated by the numeral 600. The coiled tubing test string 600 is similar to the coiled tubing test string 300 of FIG. 3, except that a production screen or perforated sub 602 and perforating gun 604 have been added below the inflatable packer 302. The bridge plug 304 is originally carried on the lower end 612 of perforating gun 604.

The previously existing perforations 24 may again be described as defining a first zone 606 of the subsurface formation 16. The perforating gun 604 is utilized to create a new set of perforations 608 defining a new subsurface zone 610 of the subsurface formation 16.

The new zone 610 is then flow tested. Then coiled tubing test string 600 is withdrawn and the well is placed back on production. Bridge plug 304 is withdrawn if it is desired to produce both zones 606 and 610. It is left if only the new zone 610 is to be produced.

Perforating Without Testing

The embodiments of FIGS. 4, 5 and 6 including perforating guns in their coiled tubing test strings, illustrate several methods for perforating a new zone of the existing production well and then flow testing that new zone with the coiled tubing test string. It will be appreciated that it is also possible utilizing these strings to simply perforate a new subsurface zone of the production well and then remove the coiled tubing string and allow the well to be placed back on production without having conducted draw-down and build-up tests on the new subsurface zone.

Advantages Of The Described Methods

There are several advantages provided by the methods described above. First, extensive testing may be performed on production wells without removing production tubing or mobilizing the extensive equipment necessary for pulling production tubing. The testing may be performed relatively quickly. Coiled tubing has no connections to leak and it is faster to run than is threaded jointed tubing. Also, long intervals of the wellbore may be isolated and tested using these methods, and particularly using the methods of FIGS. 3 or 6.

Thus it is seen that the methods of the present invention readily achieve the ends and advantages mentioned as well as those inherent therein. While certain preferred embodiments of the invention have been illustrated and described for the purposes of the present disclosure, numerous changes may be made by those skilled in the art, which changes are encompassed within the scope and spirit of the present invention as defined by the appended claims.

What is claimed is:

1. A method of perforating a new subsurface zone of a production well, said well having a casing set in a borehole intersecting said new subsurface zone and a pre-existing subsurface zone, said casing having a casing bore and having pre-existing perforations communicating said casing bore with said pre-existing subsurface zone, said well further having a production tubing string received within said casing and having a production tubing bore, and a production packer sealing between said casing bore and said production tubing string above said pre-existing perforations, said well having previously been on production by flowing well fluid from said pre-existing subsurface zone through said pre-existing perforations and through said production tubing bore, said method comprising:

(a) shutting down production of said well through said production tubing bore;

(b) leaving said production tubing string in place in said well and running a coiled tubing test string downward into said production tubing string, said coiled tubing test string including a coiled tubing string and a perforating gun carried by said coiled tubing string;

(c) placing said perforating gun adjacent said new subsurface zone;

(d) firing said perforating gun and thereby forming new perforations communicating said casing bore with said new subsurface zone;

(e) after step (d), removing said coiled tubing test string from said production tubing; and (f) resuming production of said well up through said production tubing bore.

2. The method of claim 1, further comprising:

in step (b), said coiled tubing test string further including a test packer carried by said coiled tubing string; and step (c) including setting said test packer within one of said casing bore and said production tubing bore above said subsurface zone, with said perforating gun located below said test packer adjacent said new subsurface zone.

3. The method of claim 2, wherein:

in step (b), said test packer is a straddle packer having upper and lower packer elements, and said perforating gun is located between said upper and lower packer elements; and step (c) includes setting said straddle packer in said casing bore with said upper and lower packer elements above and below said new subsurface zone, respectively, thereby isolating said new subsurface zone from said pre-existing subsurface zone.

4. The method of claim 2, wherein:

step (c) includes setting said test packer in said production tubing bore with said perforating gun located below said production tubing within said casing bore adjacent said new subsurface zone.

5. The method of claim 4, wherein:

in step (b), said test packer is a compression set test packer.

6. The method of claim 2 further comprising:

in step (b), said coiled tubing test string includes a bridge plug carried by said coiled tubing test string below said perforating gun; and between steps (b) and (c), setting said bridge plug to block said casing bore below said new subsurface zone and then releasing said bridge plug from said coiled tubing test string.

* * * * *